United States Patent [19]

Baker

[11] 4,148,427

[45] Apr. 10, 1979

[54] FLOWER CONTAINER

[75] Inventor: Robert L. Baker, Portland, Oreg.

[73] Assignee: Chase Gardens Wholesale, Inc., Portland, Oreg.

[21] Appl. No.: 870,625

[22] Filed: Jan. 19, 1978

[51] Int. Cl.[2] ..... B65D 5/48; B65D 5/60

[52] U.S. Cl. ..... 229/15; 229/23 BT; 248/174

[58] Field of Search ..... 206/45.19, 44; 248/174; 229/23 BT, 14 BE, 38, 37 R; 211/132

[56] References Cited

U.S. PATENT DOCUMENTS

| | | | |
|---|---|---|---|
| 2,663,490 | 12/1953 | Etra et al. | 229/38 |
| 3,197,113 | 7/1965 | Griese | 229/15 X |
| 3,487,479 | 1/1970 | Grooms | 229/15 X |
| 3,643,854 | 2/1972 | Holmes | 229/14 BE X |
| 3,687,408 | 8/1972 | Lake | 248/174 X |
| 3,815,808 | 6/1974 | Bunnell | 229/15 |
| 3,836,065 | 9/1974 | Hackenberg | 229/15 X |
| 3,918,576 | 11/1975 | Taub | 229/23 BT |

*Primary Examiner*—Davis T. Moorhead

*Attorney, Agent, or Firm*—Kolisch, Hartwell, Dickinson & Stuart

[57] ABSTRACT

A container for transport and display of cut flowers or the like. The container includes a cardboard box having a lower divider which divides the lower region of the box into two compartments. A water-tight plastic bag is placed inside the box, lining the inner surface of the box and the sides of the lower divider. An upper divider placed within the plastic bag and attached at opposite ends to opposite side walls of the box further partitions the box into four upright compartments. A lid for covering the box during transport has a pair of openings which coincide with openings in the box to provide a pair of container handles. In use, the lower region of the box is filled with water and cut flowers are placed in the four upright compartments with their stems in the water.

5 Claims, 7 Drawing Figures

FLOWER CONTAINER

BACKGROUND AND SUMMARY

The present invention relates to cardboard containers, and in particular, to containers adapted for shipping and displaying cut flowers or the like.

In the past, cut flower arrangements have been prepared for transport and display by wrapping the flower stems in soaked paper or cloth. The wrapped stems may be further encased in a plastic bag to prevent evaporative losses. This procedure is fairly laborious in that each of the flower bunches must be separately handled.

A further disadvantage of the above flower handling procedure is that, following shipping and handling, the flower arrangements must be unwrapped and made more attractive for display purposes. This not only adds to the time and expense involved, but increases the risk of damage to the flowers.

The present invention overcomes the above-mentioned problems by providing a simple, inexpensive container in which cut flowers may be shipped and attractively displayed. By this invention flower stems are kept moist by submersion in water held at the bottom of the container. Consequently, cut flower arrangements may be immediately placed in the water-bearing container without special preparation. The cut flowers are thus optimally fresh and unhandled.

To this end, the container of the present invention comprises a box partitioned by a lower divider into two lower compartments. A water-tight plastic bag is placed within the box, lining the inner walls of the box and the walls of the lower divider. An upper divider, placed within the plastic bag, and attached to the box crosswise of the lower divider, further partitions the box into four upright compartments, each for receiving one or more flower arrangements therein. A lid for covering the box during transport has a pair of openings coincident with openings in the box, the coincident openings forming container handles.

It is a principal object of this invention to provide a novel container for transporting and displaying cut flowers or the like.

It is another object of the invention to provide such a container adapted to hold water in its bottom region for keeping such flowers fresh during transport and display.

It is a specific object of the invention to provide a partitioned box having a plurality of upright compartments and a water-tight lining, whereby the bottom of the box may be filled with water.

It is yet another object of the invention to provide such a box which may be formed from a single sheet of cardboard, and made water-tight by insertion of a plastic liner therein.

These and other objects and features of the present invention will now be more fully described with reference to the following detailed description of the invention and the accompanying drawings.

DRAWINGS

DETAILED DESCRIPTION OF THE INVENTION

With reference to the figures, and particularly FIGS. 1–4, the present invention comprises a box, shown generally at 10, a display sign 12 attached to the upper edge of the back portion of the box, and a lid 14 adapted to be placed over the box during shipping or storage.

Figure 1:
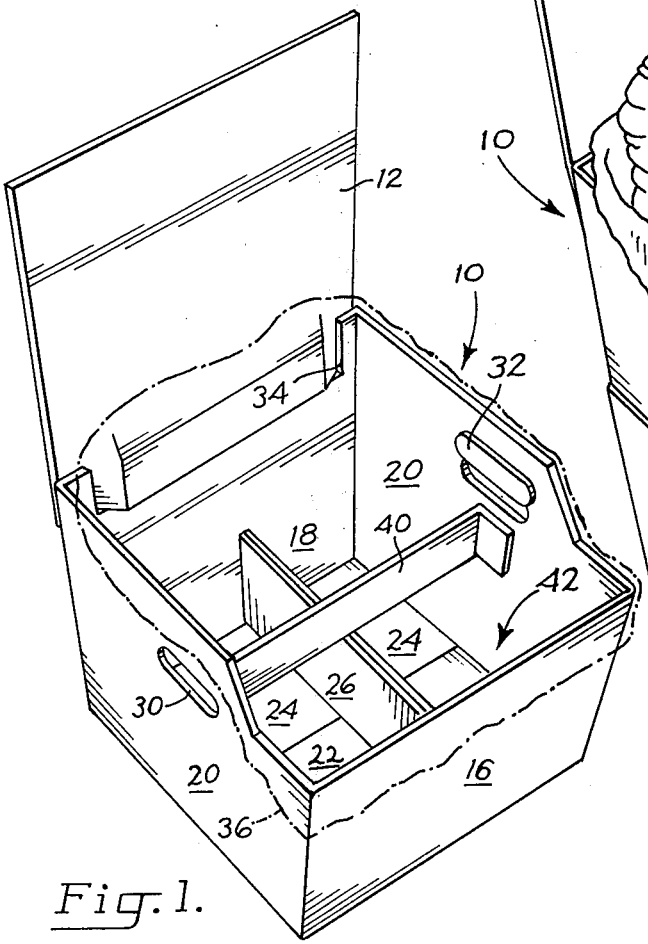
FIG. 1 is a perspective view of the container box with display sign.

Box 10 is a substantially square box having opposite front and back walls 16 and 18, opposite side walls 20, and bottom 22. Preferably the upper portion of the front and side walls are notched as best shown in FIG. 1. The bottom region of the box is partitioned into two compartments 24 by a lower divider 26. This divider is preferably integrally formed with the box structure, as described in detail below.

Figure 3:
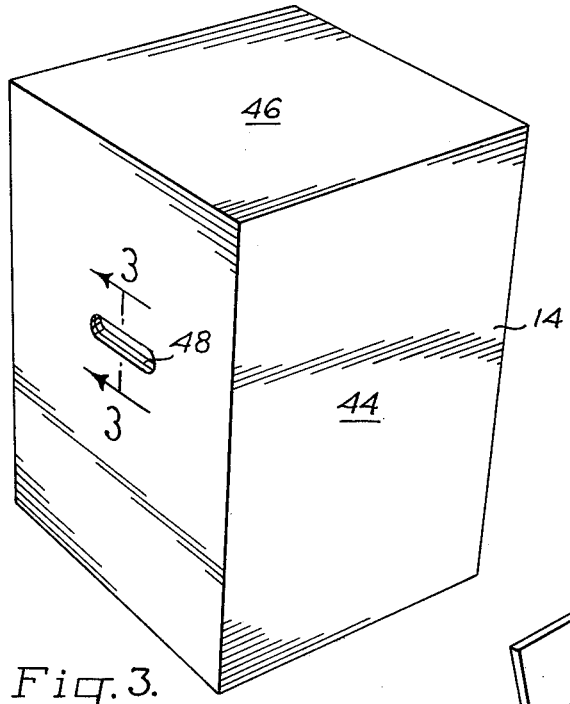
FIG. 3 is a perspective view of the covered container.
Figure 4:
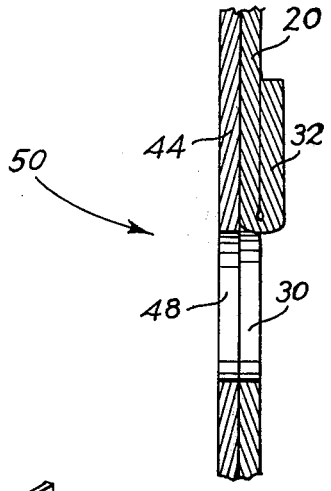
FIG. 4 is a cross-sectional view of a container handle taken along 3—3 of FIG. 4.

Also shown are a pair of box side openings 30 located in the upper center region of each side wall 20. The cutouts 32 removed in forming openings 30 are folded along the upper edges of openings 30 as shown in FIGS. 1 and 4. A pair of vertical slots 34 spaced-apart along back wall 18 are used for mounting cardboard sheet display sign 12.

The box is lined with a double-layered plastic, preferably polyethelene, bag 36. The bottom of the bag is pressed into the bottom compartments 24, thus to form two water-tight troughs at the bottom of the box, and the upper edges of bag 36 are folded over the top edges of the box to hold the bag in place within the box. For purposes of illustration, bag 36 is shown cut away in FIG. 1.

With bag 36 in place, an upper divider 40 is attached within the box to further partition the box into four upright compartments 42 defined by the upper and lower dividers. In contrast to the lower divider, which is positioned outside bag 36, the upper divider is positioned within the bag, being conventionally attached at its two ends to opposite side walls 20. The attachment of the upper divider to the box, securing portions of bag 36 therebetween further serves to hold bag 36 in place within the box.

Lid 14, which includes four sides 44 and a top 46, fits snugly over box 10, with bottom edges of sides 44 adjacent the bottom edges of the box and with lid top 46 spaced-apart from the upper edges of the box. A pair of lid openings 48 are positioned at opposite side walls 44 to coincide with box openings 30 when the lid is placed over the box. Openings 30 and 48 thus provide a pair of handles 50 for grasping the container. As seen in FIG. 4, cutouts 32 reinforce the upper gripping surface of the handles 50.

Figure 5:
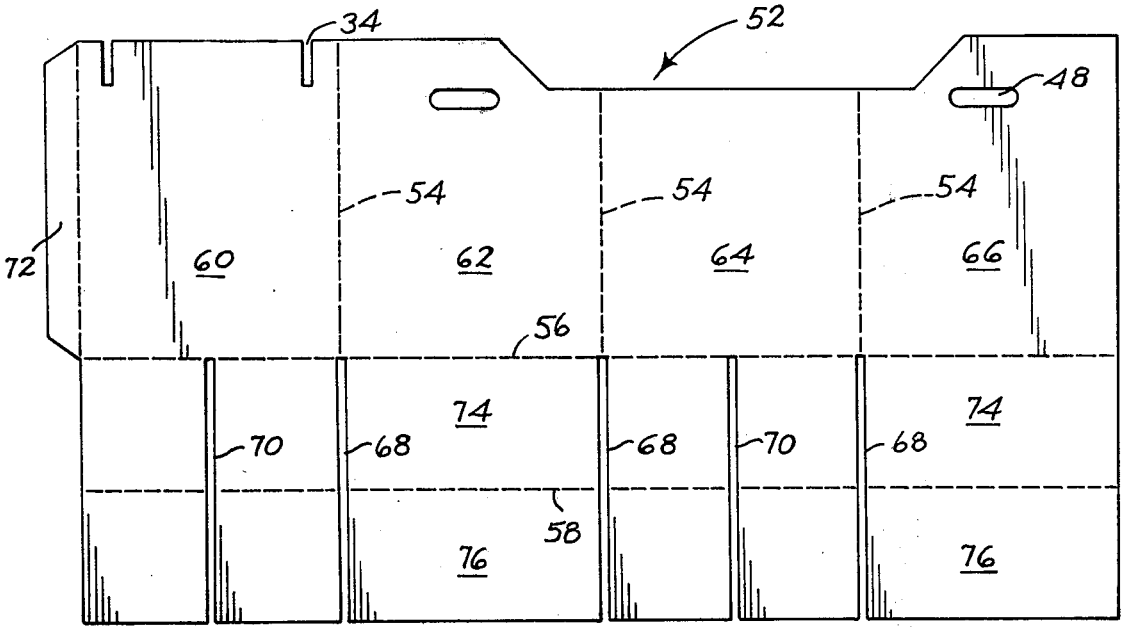
FIG. 5 is a plan view of the cardboard sheet used in constructing the container box of the present invention.
Figure 7:
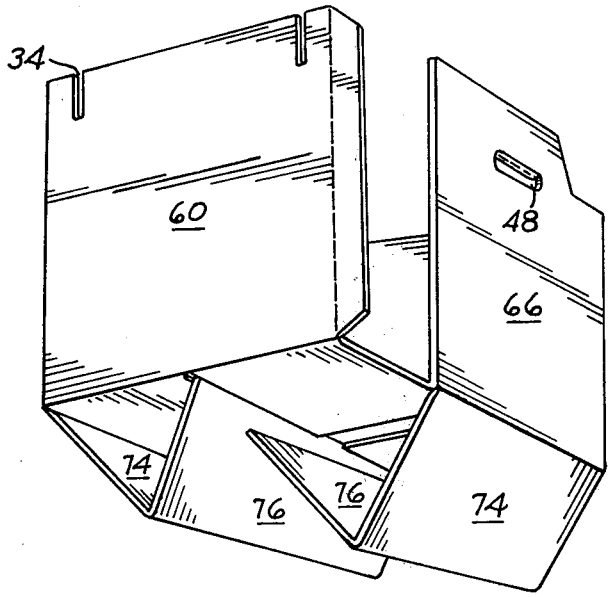
FIG. 7 is a perspective view of the sheet shown in FIG. 5, during a final step in constructing the box.
Figure 6:
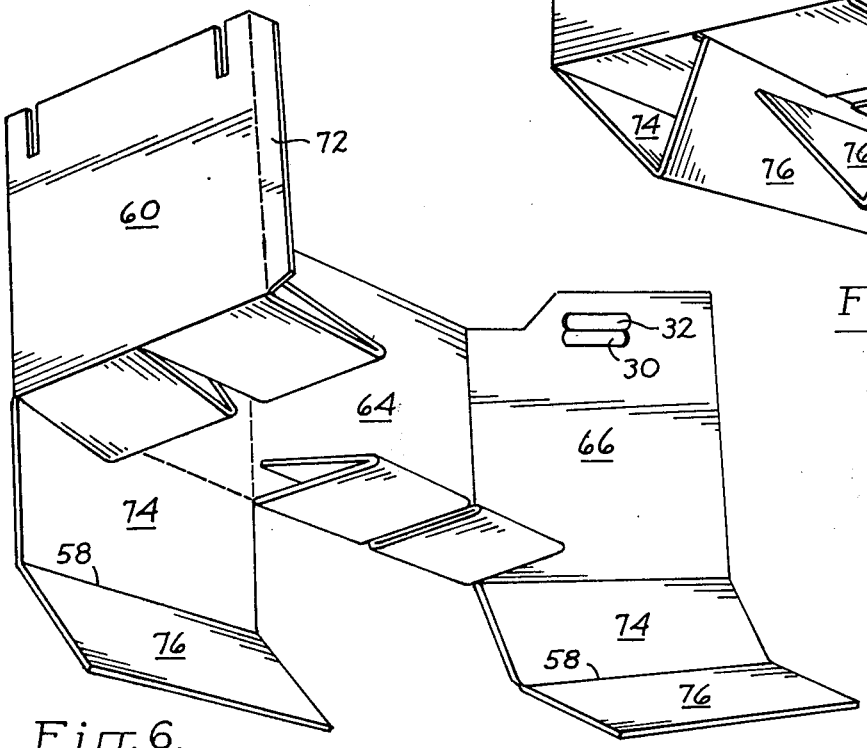
FIG. 6 is a perspective view of the sheet shown in FIG. 5, during an initial step in constructing the box.

Box 10 may be assembled from a single sheet 52 of cardboard material to form a box having a reinforced bottom 22 and an integrally formed lower divider 26. The preferred box assembly is illustrated in FIGS. 5–7.

Sheet 52 from which the box is assembled is a rectangular cardboard sheet which is divided by fold lines 54 into four substantially equal faces 60, 62, 64, and 66, designated herein as first, second, third, and fourth faces, respectively. Each face is further divided into upper and lower portions by a fold line 56, and the lower portions are further divided by a fold line 58. Three edge slots 68 separate the bottom portions of the four faces. Two center slots 70, parallel and substantially coextensive with edge slots 68, bisect the lower portions of faces 60 and 64. Also shown is a tab 72 extending along the exterior edge of the upper portion of face 60.

Figure 2:
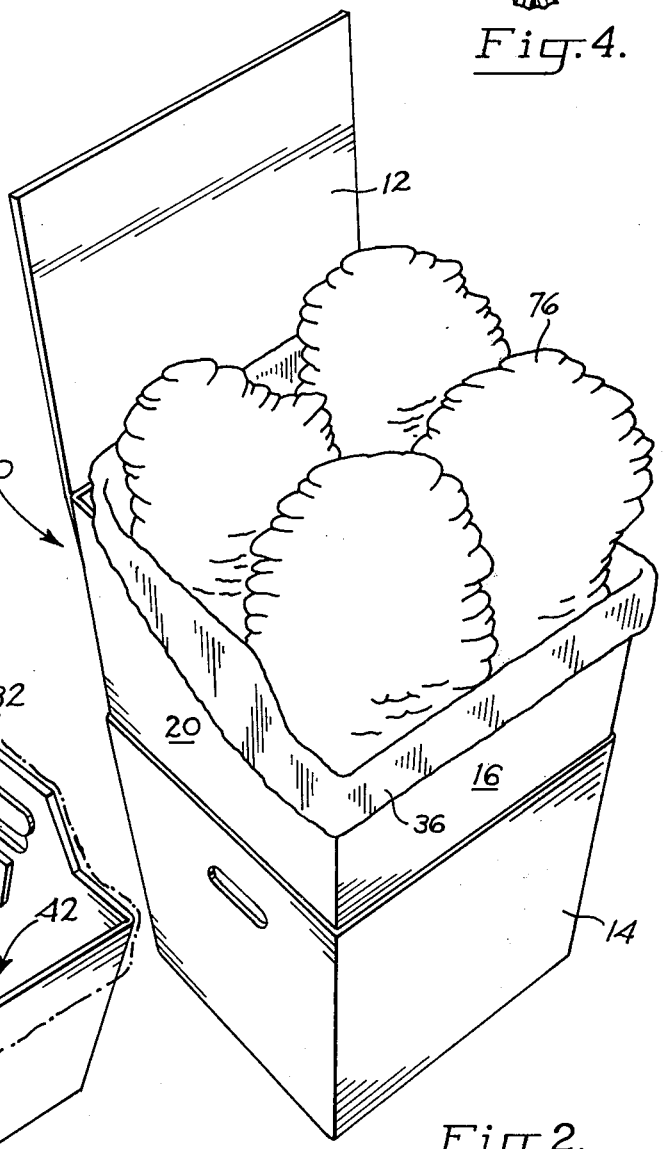
FIG. 2 is a perspective view, similar to that shown in FIG. 6 showing flower arrangements in the box.

The sheet in assembled into a box by first folding the sheet along lines 54, 56, and 58, as shown in FIG. 2. Viewing further the box assembly shown sequentially in FIGS. 6 and 7, it can be appreciated that the lower portions of faces 60 and 64 folded along line 58 and the upper moiety 74 of the lower portion of the faces 62 and 66 form three layers of a reinforced box bottom 22, and the lower moiety 76 of the lower portion of faces 62 and 66 become the upwardly extending lower divider 26. With particular reference to FIG. 5, it can be appreciated that the length of the lower portions of faces 60, 64, measured along a direction paralleling edge slots 68, is equal to the width of faces 62, 66, measured along a direction perpendicular to these edge slots, so that the lower portion of faces 60, 64, when folded along line 58, each cover half of the bottom surface of the box. The sides of the box are joined by fastening tab 72 to the exterior edge of the upper portion of face 66. Thus, the upper portion of faces 60, 62, 64 and 66 correspond to box walls 18, 20, 16 and 20, respectively.

To further prepare the box for shipping and display of flowers, plastic bag 36 is placed into the box and upper divider 40 secured therein as described above. In its use as a flower container, lower compartments 24 are each partially filled with water. Cut flower arrangement 76 are then placed in upright compartments 42, as shown in FIG. 2, with the stems of the flowers extending into the water bearing compartments 24.

The flower containing box is prepared for shipping by placing lid 46 over the box, aligning openings 48 and 30 to form container handles 50. As described above, the height of lid 14 is preferably greater than the height of the box 10, so that the tops of the flower bouquets may safely project above the upper edge of the box during shipping. Display sign 12 may be stored during shipping along one side wall of the box between such wall and the plastic bag.

To prepare the flowers for display, it is merely required to remove the lid 46, which can then be used as a box stand as shown in FIG. 2, and to mount display sign 12 in slots 34. An attractive flower display container is thereby created.

While a preferred embodiment of the invention has been described herein, it should be apparent to those skilled in the art that other variations and modifications are possible without departing from the spirit of the invention.

It is claimed and desired to secure by Letters Patent:

1. A container for transport and display of cut flowers or the like comprising a cardboard box, a lower divider partitioning the lower region of said box, a water-tight plastic bag lining the inside of said box and opposite sides of said divider, forming two water-tight bottom compartments in said lower region, and an upper divider positioned within said box and said bag, attached at its opposite ends to opposite upper interior regions of said box, with portions of said bag secured between said box and said ends, said upper divider being disposed substantially crosswise of said lower divider, forming therewith four upright compartments, each capable of holding water in its bottom region.

2. The container of claim 1 wherein said box has upper edges and which further comprises a lid having sides and a top for covering said box above said upper edges, said lid sides and said box each having a pair of handle openings which are positioned to coincide when said lid is placed over said box with the top of said lid being vertically spaced from said upper edges.

3. The container of claim 2 which further comprises a display sign adapted to be mounted along an upper edge of said box.

4. A cardboard sheet adapted to be folded into a box having a three-layered bottom and a partitioned lower region, said sheet comprising first, second, third, and fourth faces, each said face having an upper portion and a lower portion, first, second and third edge slots separating the lower portions of said first and second faces, said second and third faces, and said third and fourth faces, respectively, said first and third lower portions each having a length dimension, parallel to said edge slots, substantially equal to the width dimension of said second and fourth faces, first and second center slots, parallel to and substantially coextensive with said edge slots, said edge slots bisecting said first and third face lower portions, respectively, and tab means for joining an exterior edge of said first face upper portion with an exterior edge of said fourth face upper portion.

5. A container for transport and display of cut flowers or the like comprising a box, said box formed from a cardboard sheet having first, second, third, and fourth faces, each said face having an upper side portion and a lower bottom portion; first, second, and third edge slots separating the bottom portion of said first and second faces, said second and third faces, and said third and fourth faces, respectively; first and second center slots parallel to and substantially coextensive with said edge slots, said center slots bisecting said first and third face lower portions, respectively; and tab means for joining an exterior edge of said first face upper portion with an exterior edge of said fourth face upper portion, said upper portions forming opposite side walls and opposite front and back walls of said box, and said lower portions forming a bottom of the box and a lower divider partitioning the lower region of the box into two bottom compartments, a water-tight plastic bag lining the inside of said box and said lower divider, and an upper divider positioned within said plastic bag, said upper divider attached at its opposite ends to two of said walls above and substantially crosswise to said lower divider to further partition the box into four upright compartments.

* * * * *